United States Patent [19]

Bridges et al.

[11] 4,135,669

[45] Jan. 23, 1979

[54] PORTABLE, WHEELED ELECTRIC SPRAYER WITH PRESSURIZED LIQUID RESERVOIR

[76] Inventors: Edward B. Bridges; Lillian K. Bridges, both of 1303 Stanton Ave., Waycross, Ga. 31501

[21] Appl. No.: 829,198

[22] Filed: Aug. 30, 1977

[51] Int. Cl.[2] ..... B05B 7/24

[52] U.S. Cl. ..... 239/373; 239/146; 239/391

[58] Field of Search ..... 239/146, 373, 390, 391

[56] References Cited

U.S. PATENT DOCUMENTS

| | | | |
|---|---|---|---|
| 851,758 | 4/1907 | Kauffman | 239/373 X |
| 1,750,512 | 3/1930 | Ewald | 239/373 X |
| 1,788,269 | 1/1931 | Bacon | 239/373 X |
| 2,928,533 | 3/1960 | Loucony | 239/391 |
| 3,016,200 | 1/1962 | Boehm | 239/373 X |
| 3,265,308 | 8/1966 | Hopkins | 239/373 X |

FOREIGN PATENT DOCUMENTS

| | | | |
|---|---|---|---|
| 558241 | 12/1957 | Belgium | 239/373 |

*Primary Examiner*—Robert W. Saifer

*Attorney, Agent, or Firm*—Clarence A. O'Brien; Harvey B. Jacobson

[57] ABSTRACT

A hollow pressure vessel is provided and includes an upwardly opening filler neck supported from an upper portion thereof and a removable fluid pressure sealing closure is carried by the filler neck. A liquid outlet tube opens upwardly through an upper portion of the vessel from the interior thereof in sealed engagement with the upper vessel portion. The lower end of the tube opens outwardly within a lower portion of the vessel and a flexible pressure hose has one end connected to the upper end of the tube outwardly of the pressure vessel. A tubular spray wand has one end connected to the other end of the hose and the spray wand includes a discharge spray head on the other end thereof. In addition, the spray wand includes a control valve therefor intermediate the opposite ends of the wand for controlling the flow of liquid through the wand and a motorized compressor is mounted on an upper portion of the vessel and includes a compressed air outlet opening into the interior of the vessel in sealed engagement therewith. The compressed air outlet opens into the interior of the filler neck below the removable closure thereof and the latter includes an exterior pressure gauge opening into the interior of the neck through the closure. Further, the neck includes a manually openable and closable vent valve diametrically opposite the compressed air outlet opening into the interior of the filler neck.

4 Claims, 8 Drawing Figures

102
94
62
68
70
92
66
3
56
64
38
58
80
56
58
60
34
36
54
52
32
26
28
30
50
3
76
10
88
12
78
18
90
20
16
14
22
24

38
44
40
46
4
4
42
28
48

40
28

PORTABLE, WHEELED ELECTRIC SPRAYER WITH PRESSURIZED LIQUID RESERVOIR

BACKGROUND OF THE INVENTION

Various forms of portable sprayers have been heretofore provided. However, most portable sprayers have included manual pumps for maintaining air pressure therein and considerable time and effort must be expended in order to maintain the desired air pressure within a tank of reasonably large capacity by means of a manual pump.

Although motorized sprayers have also been provided, motorized sprayers are usually of such weight and bulk to render them inoperable as portable devices.

Accordingly a need exists for a motorized sprayer including a reasonably large capacity pressure tank and a motorized compressor for pressurizing the tank, but which is constructed in a manner rendering the sprayer of lightweight construction. In this manner, the sprayer may be utilized in the vicinity of a suitable power source for operating the compressor, and yet may be pressurized while in the vicinity of the power source and thereafter readily transported to a remote location for spraying operations.

Various forms of sprayers including some of the general structural and operational features of the instant invention are disclosed in U.S. Pat. Nos. 1,141,243, 2,275,594, 3,016,200, 3,023,969 and 3,940,065.

BRIEF DESCRIPTION OF THE INVENTION

The sprayer of the instant invention includes a pressure vessel which may have an internal volume of between two and ten gallons and which includes a pair of opposite side lower end wheels journaled therefrom whereby the pressure vessel may be readily transported to a remote location. The wheels and pressure vessel are of lightweight construction and a small capacity electric motor driven compressor is mounted atop the pressure vessel and is operative to pressurize the interior of the vessel above a quantity of liquid disposed therein through a pressure discharge line from the compressor opening into and upwardly and outwardly projecting filler neck for the vessel. The filler neck includes a removable closure for the outer end thereof and a liquid outlet tube opens upwardly through an upper portion of the vessel from the interior thereof in sealed engagement therewith and has a flexible hose connected to its outlet end with an elongated tubular wand being supported from the outlet end of the hose, the outlet end of the wand being provided with a spray head.

The main object of this invention is to provide a high pressure lightweight sprayer including a pressure vessel which may be maintained constantly under pressure by means of a small capacity electric motor driven compressor supported from the vessel and yet which is of sufficiently lightweight construction whereby the sprayer may have its tank pressurized by means of the compressor and thereafter transported with ease to a remote location for subsequent use independent of a source of electricity.

Yet another object of this invention is to provide a sprayer constructed in a manner whereby the interior thereof may be readily vented from a level above any liquid remaining in the vessel.

Another important object of this invention is to provide a pressure vessel including a filler neck having a removable fluid pressure sealing closure therefor.

A further object of this invention is to provide a pressurized sprayer with which a variety of spraying and air outlet nozzles may be used.

A final object of this invention to be specificially enumerated herein is to provide a sprayer in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
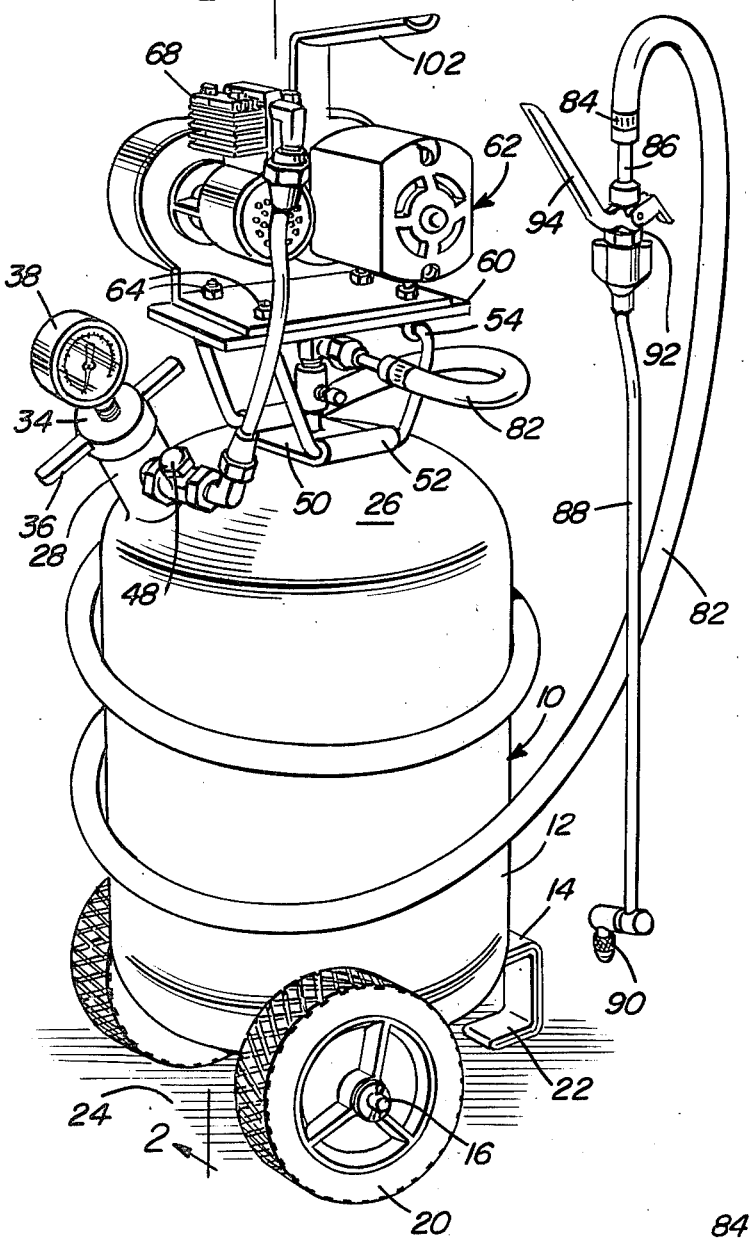
FIG. 1 is a perspective view of the sprayer of the instant invention.
Figure 5:
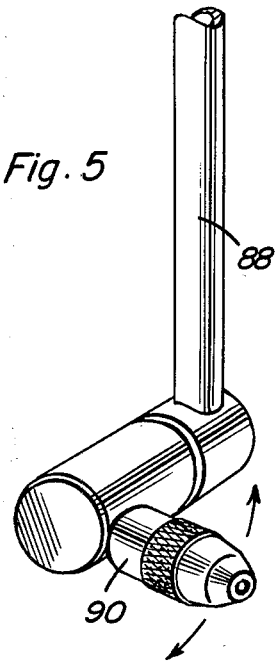
FIG. 5 is a fragmentary, perspective view of the outlet end portion of the spray wand of the sprayer illustrating the swivelly mounted spray head thereon.

Referring now more specifically to the drawings, the numeral 10 generally designates the sprayer of the instant invention. The sprayer 10 includes a pressure vessel 12 having a bracket 14 secured, as by welding, to the lower end thereof. In addition, a horizontal transverse axle 16 is secured by welding to the lower end wall 18 of the vessel 12 and a pair of wheels 20 are journaled on the opposite ends of the axle 16. The axle 16 is spaced forward of the vertical center line of the vessel 12 and the bracket 14 extends rearwardly of the rear side of the vessel 12 and includes a depending foot structure 22 for engagement with the ground 24 upon which the wheels 20 rest. In this manner, the wheels 20 and the foot structure 22 are operative to support the vessel 12 from the ground 24 in an upright position such as that illustrated in FIGS. 1 and 2 of the drawings.

The vessel 12 includes an upper or top wall 26 through which an upwardly and outwardly inclined filler neck 28 opens. The lower end of the filler neck 28 is secured by welding in an opening 30 formed in the top wall 26 and the upper end of the filler neck 28 is externally threaded as at 32 and has a fluidtight pressure cap 34 removably threadedly secured thereover. The pressure cap 34 includes diametrically opposite radially outwardly projecting handles 36 by which the cap 34 may be manually removed and reapplied. Also, the pressure cap 34 supports an exterior pressure gauge 38 therefrom threadedly secured through a central portion of the cap 34 for communication with the interior of the filler neck 28.

The filler neck 28 includes a manually openable and closable vent valve 40 opening into the interior of the neck 28 and the side of the neck 28 diametrically opposite the vent valve 40 includes an inlet conduit 42 for admitting air under pressure into the interior of the neck 28. The inlet conduit 42 includes an inlet end 44 and an outlet end 46 secured through the side wall portion of the filler neck 28 remote from the vent valve 40. In addition, a check valve assembly 48 is serially connected in the conduit 42.

The central portion of the top wall 26 of the vessel 12 has a mounting plate 50 secured over the outer surface thereof and the mounting plate 50 includes a pair of parallel sleeves 52 supported from and extending along opposite marginal edge portions thereof. A pair of inverted U-shaped supports 54 have the lower ends of the legs thereof horizontally directed toward each other and secured in opposite ends of the sleeves 52 and the upper bight portions 56 of the supports 54 are passed through sleeves 58 welded to the underside of an upper mounting plate 60 from which a combined electric motor and compressor assembly referred to in general by the reference numeral 62 is removably supported by means of fasteners 64. The assembly 62 includes an electric motor 66 and a compressor 68 driven by the motor 66. The compressor 68 includes an outlet line 70 and the outlet line 70 has its discharge end sealingly communicated with the inlet end of the conduit 42. Accordingly, operation of the motor 66 to drive the compressor 68 is operative to cause air under pressure to be discharged through the line 70 and the conduit 42 into the interior of the vessel 12 through the filler neck 28 thereof.

A vertical outlet tube 76 is secured downwardly through the central portion of the plate 50 and the top wall 26 in fluidtight sealed engagement therewith and the lower end 78 of the tube 76 opens into the lower end portion of the interior of the vessel 12. The upper end of the tube 76 has an elbow fitting 80 secured thereto and the inlet end of a flexible pressure hose 82 is connected to the fitting. The outlet end of the pressure hose 82 includes a rotable tubular nut 84 by which the outlet end of the hose 82 is removably secured to the inlet end 86 of a tubular wand 88 having a spray head 90 swivelly mounted on its discharge end. The wand 88 includes a fluid flow controlling valve 92 intermediate its opposite ends under the control of a manually actuatable lever 94.

Figure 6:
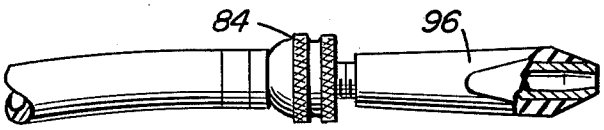
FIG. 6 is a side elevational view of an inflation nipple which may be mounted on the outlet end of the flexible hose of the sprayer in lieu of the spray wand.
Figure 7:
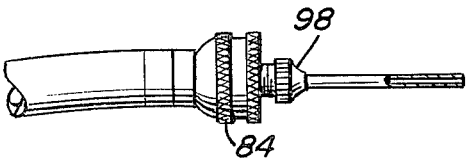
FIG. 7 is a side elevational view of an inflation needle which may be mounted on the outlet end of the flexible hose in lieu of the spray wand.
Figure 8:
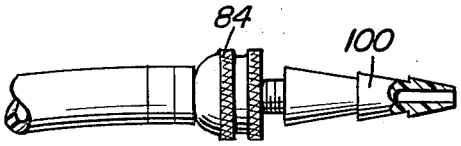
FIG. 8 is a side elevational view of a blow nozzle which may be mounted on the outlet end of the flexible hose in lieu of the spray wand.

In lieu of the wand 88, an inflation nipple 96 may be threadedly supported from the nut 84, see FIG. 6, or an inflation needle 98 may be supported from the nut 84, see FIG. 7. Further, with attention invited more specifically to FIG. 8, a blow nozzle 100 may be supported from the nut 84 in lieu of the wand 88.

Figure 2:
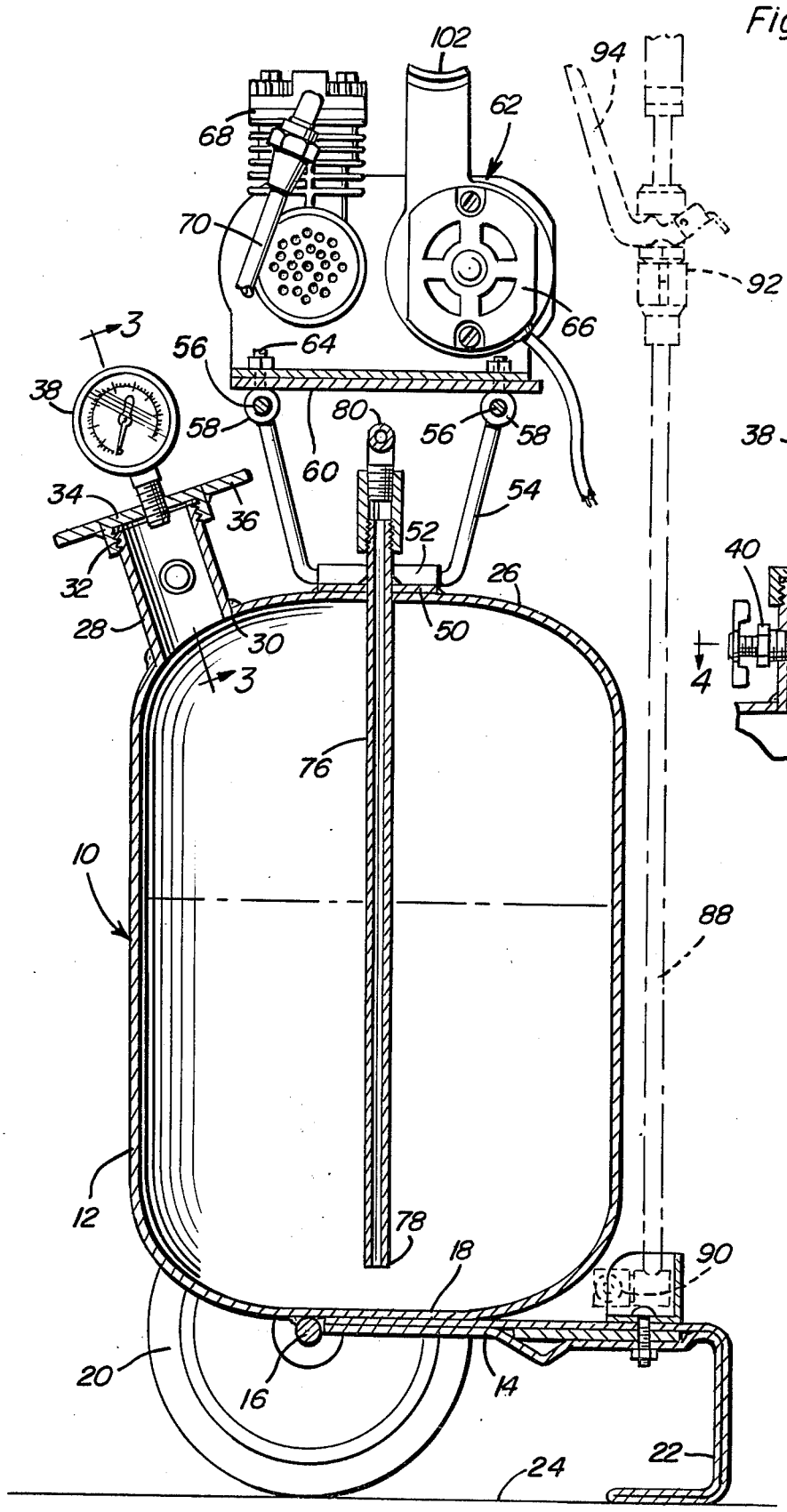
FIG. 2 is an enlarged, vertical sectional view taken substantially upon the plane indicated by the section line 2—2 of FIG. 1.
Figure 3:
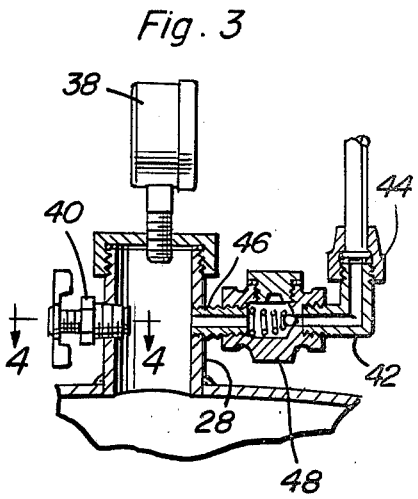
FIG. 3 is a fragmentary, vertical sectional view taken substantially upon the plane indicated by the section line 3—3 of FIG. 2.
Figure 4:
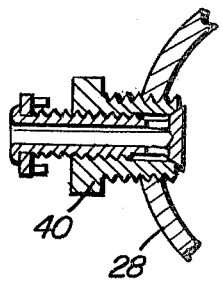
FIG. 4 is a fragmentary, enlarged, horizontal sectional view taken substantially upon the plane indicated by the section line 4—4 of FIG. 3.

From FIGS. 1 and 2 of the drawings, it may be seen that the assembly 62 includes a handle 102 by which the entire sprayer 10 may be readily carried from one location to another in the event there are no ground or floor surfaces suitable for rollingly supporting the sprayer 10 therefrom by the wheels 20. The sprayer 10 is of lightweight construction and the assembly 62 is of limited capacity so as to maintain the over-all weight of the sprayer 10 at a minimum. Further, the volume of the vessel 12 may be between two and ten gallons and the vessel 10 may be pressurized at one location by the motor 66 and thereafter transported to a remote location for subsequent use independent of a source of electrical potential.

It is also pointed out that the vent valve 40 is supported from the filler neck 28, thereby insuring that a person wishing to remove the closure 34 by means of the handles 36 will be reminded to make sure that the interior of the vessel 12 has been vented through the vent valve 40. In addition, the pressure gauge 38 is supported from the closure 34 for the neck 28 and the check valve assembly 48 is supported from the neck 28. Accordingly, access to the ends of the pressure gauge 38, the vent valve 40 and the check valve assembly 48 opening into the neck 28 may be readily gained.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A lightweight pressure sprayer assembly comprising a hollow pressure vessel, a filler neck opening into the interior of an upper portion of said vessel and including a removable fluid pressure sealing closure therefor, an upstanding liquid outlet tube opening upwardly through said upper portion of said vessel from the interior thereof in sealed engagement with said upper portion, the lower end of said tube opening outwardly within a lower portion of said vessel, a flexible pressure hose having one end connected to the upper end of said tube, a tubular spray wand having one end connected to the other end of said hose, said spray wand including a discharge spray head on the other end thereof and including a control valve therefor intermediate the opposite ends of said wand for controlling the flow of liquid through said wand, and a lightweight motorized air compressor mounted on said upper portion of said vessel and having a compressed air outlet opening into the interior of said vessel in sealed engagement therewith, said air outlet opening into the interior of said neck inwardly of said closure, said closure including an exterior pressure gauge supported therefrom opening into the interior of said vessel through said closure, said neck including a manually openable and closable vent valve supported therefrom for selectively venting the interior of said vessel to the ambient atmosphere, said sprayer including wheeled support means supported from a lower portion of said vessel by which said sprayer may be readily rolled over the ground, a generally horizontal mounting plate supported from and spaced vertically above said upper portion, said motorized air compressor being mounted atop said mounting plate and including an upper handle portion from which the total weight of said sprayer assembly may be supported and by which said sprayer assembly may be hand carried and/or lifted as one desires, the vertical spacing between said upper portion and said mounting plate providing a space therebetween for said upper end of said outlet tube and said one end of said pressure hose, said pressure gauge and vent valve being supported from said closure and neck, respectively, whereby a person preparing to remove said closure for the purpose of adding liquid to the interior of said tank through said neck will be reminded to vent the interior of said tank to the ambient atmosphere through said vent valve before removing said closure.

2. The combination of claim 1, wherein said discharge spray head is swivelly supported from said other end of said wand.

3. The combination of claim 1, wherein said other end of said hose and said one end of said wand include co-acting means removably supporting said wand from said hose.

4. The combination of claim 1, wherein said vent valve and air outlet open into diametrically opposite portions of said filler neck.

* * * * *